United States Patent [19]

Muryn

[11] 4,245,820

[45] Jan. 20, 1981

[54] PIPE CURTAIN FOR POLLUTION CONTROL HOOD

[75] Inventor: Stephen Muryn, Wheeling, W. Va.

[73] Assignee: Wheeling-Pittsburgh Steel Corporation, Pittsburgh, Pa.

[21] Appl. No.: 59,245

[22] Filed: Jul. 20, 1979

[51] Int. Cl.[3] ..... C21B 7/22; C21C 5/40

[52] U.S. Cl. ..... 266/158; 98/115 R; 266/144

[58] Field of Search ..... 266/142, 144, 158; 98/36, 115 R, 115 LH

[56] References Cited

U.S. PATENT DOCUMENTS

| | | | |
|---|---|---|---|
| 3,205,810 | 9/1965 | Rosenak | 98/115 |
| 3,325,158 | 6/1967 | Ginder | 266/27 |
| 3,445,101 | 5/1969 | Reighart | 266/158 |
| 3,834,293 | 9/1974 | Danieli | 98/36 |
| 3,963,222 | 6/1976 | Nagati | 266/158 |
| 4,076,223 | 2/1978 | Schempp | 266/158 |
| 4,094,496 | 6/1978 | Readal | 266/142 |
| 4,097,029 | 6/1978 | Ziegler | 266/142 |

*Primary Examiner*—F. C. Edmundson

*Attorney, Agent, or Firm*—Stanley J. Price, Jr.; John M. Adams

[57] ABSTRACT

A pipe curtain is formed by a plurality of pipes independently suspended at one end portion to an outwardly extending flange positioned around a pollution control hood positioned at the discharge of a metallurgical furnace. Molten metal is transferred from the furnace to a metal transporting vessel through a trough, spout or the like. The hood is positioned above the trough and fans for the hood draw emissions, such as gaseous and particulate pollutants emitted from the molten metal, into the hood. The vertically suspended pipes are positioned in close relation to each other and substantially enclose the space between the bottom edge of the hood and the upper edge of the trough. With this arrangement the pipes form a curtain that prevents the air entrained pollutants emitted from the molten metal from escaping out from beneath the hood to the surrounding atmosphere. The pipe curtain substantially reduces the volume of surrounding air drawn into the hood to thereby permit use of fans and other pollution control equipment of reduced capacity. The pipes have sufficient weight not to be displaced from their vertically suspended position by the air flow into the hood. The pipes are also individually, movably connected to the hood to permit access to the space beneath the hood while the curtain remains substantially in position to prevent the escape of pullutants.

12 Claims, 11 Drawing Figures

PIPE CURTAIN FOR POLLUTION CONTROL HOOD

BACKGROUND OF THE INVENTION

1. Field of the Invention

This invention relates to apparatus for controlling the withdrawal of pollutants from an industrial atmosphere and more particularly to an arrangement of pipes that extend downwardly from a pollution control hood to form a curtain for minimizing the volume of air drawn into the hood with the pollutants while permitting access to the area beneath the hood.

2. Description of the Prior Art

In a metallurgical process molten metal is transferred from a furnace through an inclined spout, an open trough, runner or the like into a transport vessel, such as a ladle or a hot metal car for movement of the molten metal to another furnace. In the past the outlet of the spout or the trough was open to the atmosphere so that the flow of the molten metal into the receiving vessel could be observed; however, current environmental regulations require that a pollution control hood be positioned over the trough and that the hood be equipped with fans for exhausting the gaseous and particulate pollutants emitted from the molten metal to prevent discharging the pollutants into the surrounding atmosphere. The hood cannot completely enclose the trough so as to prevent access to the trough. Consequently, the size of the motors, fans, air cleaners and the like installed in a pollution control hood is determined by the volume of air that must be withdrawn from above the trough to prevent the pollutants from entering the surrounding atmosphere.

One of the problems encountered in collecting gaseous and particulate pollutants by a pollution control hood is the capacity of the fans and the other air cleaning equipment to efficiently draw the pollutants out of the surrounding atmosphere. However, the capacity of the fans must be large if the space between the hood and the trough is open to the surrounding ambient air in order to create sufficient negative pressure to draw the pollutants into the hood. Thus, in order to reduce the capacity of the fans it is desirable to minimize as much as possible the volume of ambient air pulled into the hood by the negative pressure created by the fans and yet permit access to the trough.

U.S. Pat. Nos. 4,076,223; 4,094,496; and 4,097,029 disclose for steel converting apparatus an enclosure that surrounds a vessel for converting molten ferrous metal to steel. The enclosure cooperates with a smoke hood that is positioned in spaced relation above the opening into the vessel. A movable, rigidly constructed skirt is positioned in surrounding relation with the annular space between the bottom of the smoke hood and the top of the vessel. The skirt is a unitary structure composed of a plurality of tubes affixed in a side-by-side relation by intervening bar members and in an annular configuration. The skirt is vertically lifted by a hydraulic lift mechanism between a raised position to permit an indraft of air into the hood and a lowered position minimizing the flow of air into the hood. Consequently to permit access to the annular space above the vessel to observe the conversion operation in the vessel, the entire skirt must be lifted permitting pollutants to be discharged into the surrounding atmosphere.

U.S. Pat. No. 3,834,293 discloses equipment for conveying the products of combustion in a smelting furnace. A plurality of nozzles positioned around the periphery of the furnace are directed upwardly and compressed air is emitted from the nozzles to form a fluid wall or a screen to form an insulated chamber directed from the furnace to the pollution control hood. With this arrangement the combustion products are extracted from the surrounding atmosphere in a manner which permits the use of a hood of reduced size and power requirements.

An adjustable hood having a wide mouth for preventing excessive air infiltration into the furnace during a refining operation is disclosed in U.S. Pat. No. 3,205,810. An outer duct is adjustably positioned to vary the size of an annular passageway between the outlet of the furnace and the inlet to the exhaust hood. In this manner the volume of air flowing into the exhaust hood is controlled for the most economical operation of the fan associated with the hood.

U.S. Pat. No. 3,325,158 discloses a blast furnace stockline protective device that includes a plurality of arcuate plates that extend downwardly and around a bell-hopper. The plates are operable to protect the refractory lining of the blast furnace from the charge entering the furnace from the bell-hopper. The plates are individually suspended from the hopper and are easily replaced and are moved into and out of position relative to the refractory wall of the blast furnace.

There is need for pollution control apparatus operable to limit the volume of air drawn into a pollution control hood that extracts from an industrial atmosphere pollutants emitted during an industrial process, such as the pollutants emitted from molten metal when conveyed from the blast furnace or the like to a metal transporting vessel. While it has been suggested to minimize the flow of air into a pollution control hood so as to permit the use of pollution control equipment of reduced capacity, the prior art devices do not provide an enclosure that efficiently minimizes the inflow of surrounding air into the hood while permitting access to the space beneath the hood to observe the metallurgical process without discharging pollutants into the surrounding atmosphere.

SUMMARY OF THE INVENTION

In accordance with the present invention there is provided apparatus for controlling the flow of air and pollutants drawn into a pollution control hood that includes a plurality of pipe-like members arranged individually to extend downwardly from the pollution control hood. The pipe-like members are positioned independently in side-by-side relation to form a curtain extending around the pollution control hood and thereby adapted to enclose the opening into the hood. The pipe-like members each have a first end portion secured to the pollution control hood and a second end portion adapted to freely overlie in close proximity the periphery of a vessel from which the pollutants are emitted. The curtain formed by the pipe-like members is operable to reduce the volume of air surrounding the pollution control hood from being drawn into the hood with the emitted pollutants.

Each of the pipes is arranged to suspend freely at the first end portion from a flange that extends downwardly and around the lower peripheral edge of the hood. A hanger or connecting device is provided for each pipe on the hood flange so that the pipes are individualy connected to the flange and easily displaced from a vertically hanging position or removable from engagement with the flange. Preferably, the pipes extend vertically downwardly and are positioned in abutting relation with each other. The second or lower end portion of each pipe is positioned closely adjacent to the upper peripheral edge of the vessel from which the pollutants are emitted.

In one embodiment the vessel may include an inclined trough that extends from the outlet of a steel making furnace to a metal transporting device, such as a ladle or a hot metal car. The hood is spaced in overlying relation with the trough. By the arrangement of the pipes extending downwardly from the peripheral flange of the hood in surrounding relation with the open upper edge of the trough, the space between the hood and the trough is enclosed by the curtain formed by the pipes.

The pipe curtain has sufficient weight to remain in place and resist displacement by the flow of air and pollutants into the hood. With this arrangement an enclosure is maintained between the hood and the vessel or trough so that substantially all the pollutants are drawn into the hood. The pollutants, both gaseous and air entrained paricles, emitted from the molten metal are efficiently contained within the enclosure formed by the pipe curtain and are thereby prevented from escaping into the surrounding atmosphere. The inflow of surrounding ambient air into the hood is restricted by the barrier formed by the pipe curtain. Consequently, the power requirements of the pollution control hood can be substantially reduced because of the reduced inflow of air into the hood. This arrangement provides a more economical method for removing the pollutants emitted by the molten metal from the atmosphere.

Accordingly, the principal object of the present invention is to provide apparatus for controlling the flow of air and pollutants drawn into a pollution control hood in which the volume of air drawn into the hood is minimized.

Another object of the present invention is to provide a pipe curtain for a pollution control hood used for withdrawing pollutants from the atmosphere in an industrial process where the curtain substantially restricts the inflow of surrounding air into the hood while permitting access to the space beneath the hood without discharging pollutants.

A further object of the present invention is to provide for a pollution control hood a curtain formed by a plurality of individual pipes suspended independently from the peripheral edge of the hood and downwardly into surrounding relation with a vessel beneath the hood where the space between the flange of the hood and the upper edge of the vessel is enclosed by the curtain so as to direct the pollutants emitted from the vessel into the hood.

An additional object of the present invention is to provide for a pollution control hood a pipe curtain having sufficient weight not to be drawn out of position beneath the hood by the flow of air into the hood and movably connected to the hood to permit access to the space beneath the hood without completely removing the entire curtain from around the hood.

These and other objects of the present invention will be more completely disclosed and described in the following specification, the accompanying drawings and the appended claims.

DESCRIPTION OF THE PREFERRED EMBODIMENTS

Figure 2:
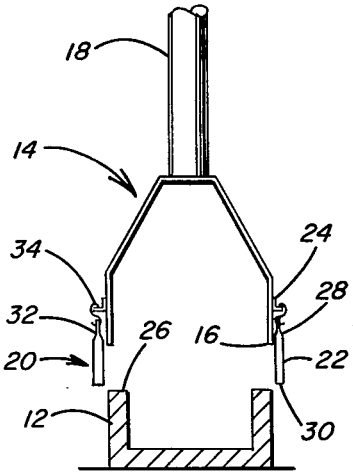
FIG. 2 is a sectional end view of the pollution control hood and trough shown in FIG. 1, illustrating the pipes hanging from the hood to enclose the space between the hood and the trough.
Figure 1:
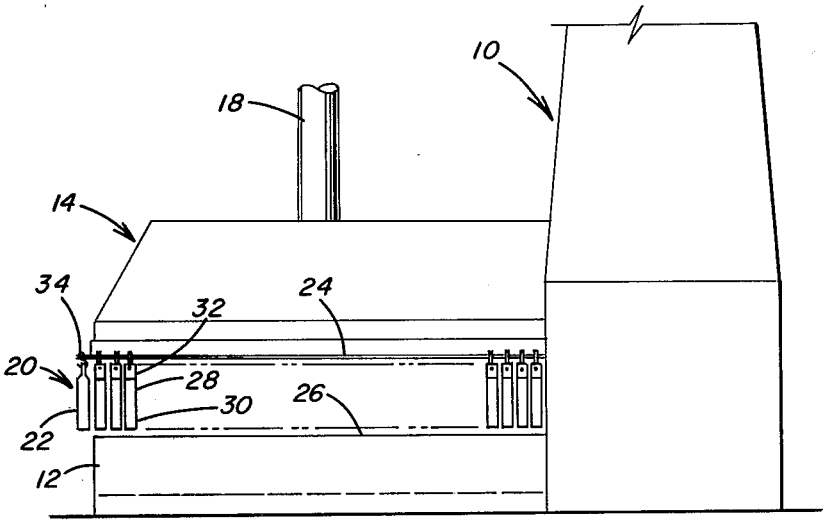
FIG. 1 is a view in side elevation of a pollution control hood associated with a metallurgical furnace from which molten metal is conveyed into a trough for transfer to a metal transporting device, schematically illustrating a curtain formed by a plurality of individual pipes suspended from the hood to form an enclosure around the space between the hood and the trough to contain the pollutants beneath the hood.

Referring to the drawings and particularly to FIG. 1 there is illustrted a furnace generally designated by the numeral 10 adapted for use in a metallurgical process, such as a blast furnace from which molten metal is transferred in an inclined trough 12 to another metal transporting vessel (not shown in FIG. 1). As illustrated in FIG. 2 the trough 12 has a U-shaped configuration for receiving the molten metal in which the upper portion of the trough is open. Positioned in overlying relation and spaced above the trough 12 is a pollution control hood generally designated by the numeral 14. The pollution control hood 14 has an inlet 16 overlying the trough 14 for receiving pollutants, such as smoke, gaseous products, air entrained particular matter, and the like emitted from the molten metal as it is conveyed through the trough 12.

The pollution control hood 14 is connected by a conduit or stack 18 to suitable pollution control equipment, for example air cleaners, fans, quenchers, scrubbers, etc. (all not shown). A fan is associated with the conduit 18 and the pollution control apparatus for creating a suction immediately below the hood 14. and above the trough 12 for drawing the pollutants emitted from the molten metal in the trough 12 into the conduit 18 and to the pollution control equipment so as to prevent the pollutants from being emitted into the surrounding atmosphere.

In accordance with the present invention a pollution control curtain generally designated by the numeral 20 is supported by the hood 14 to hand downwardly into surrounding relation with the space between the trough 12 and the hood 14. The curtain 20 is operable to confine the pollutants emitted from the molten metal in the area above the trough and beneath the hood and prevent discharge of the pollutants to the surrounding atmosphere. The pollution control curtain 20 is formed by a plurality of individual pipe-like members 22 which are freely suspended at one end portion to a flange 24 that extends around the lower peripheral edge of the hood 14. Each of the pipes 22 is independently suspended from the flange 24 and is positioned in close relationship to one another to substantially completely enclose the space between the opening 16 into the hood and upper edge 26 of the trough 12.

The vertically extending pipes serve as a curtain to substantially reduce the volume of ambient air pulled into the area beneath the hood 14 by the negative pressure created by the fan connected to the conduit 18. By providing the pollution control curtain 20 in the form of a plurality of closely positioned pipes 22, the curtain has sufficient weight to maintain the area beneath the hood enclosed and is further operable to resist displacement from this configuration by the flow of air into the hood 14.

Figure 3:
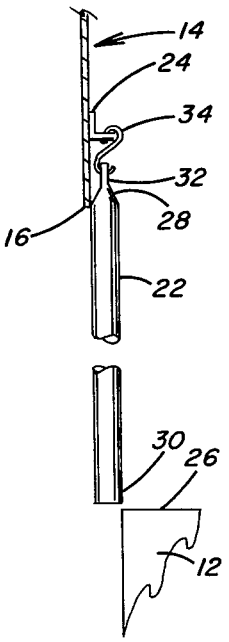
FIG. 3 is an enlarged fragmentary sectional view of one embodiment for suspending each of the pipes from a peripheral flange of the hood to extend downwardly closely adjacent to the trough.

As illustrated in greater detail in FIG. 3 each of the pipes 22 has a first end portion 28 pivotally connected to the hood flange 24 and a second end portion 30 positioned above and closely adjacent to the trough upper edge 26. The first or upper end portion 28 of each pipe 22 is provided with a lug 32 having an aperture therethrough. Positioned opposite the lug 32 is the hood flange 24 which is also provided with an aperture. A suitable connecting device 34, such as a S-shaped hook, is arranged to engage the apertures of the hood flange 24 and the pipe lug 32 so as to independently connect each pipe on the flange in a manner that the pipe is suspended from the flange.

Figure 4:
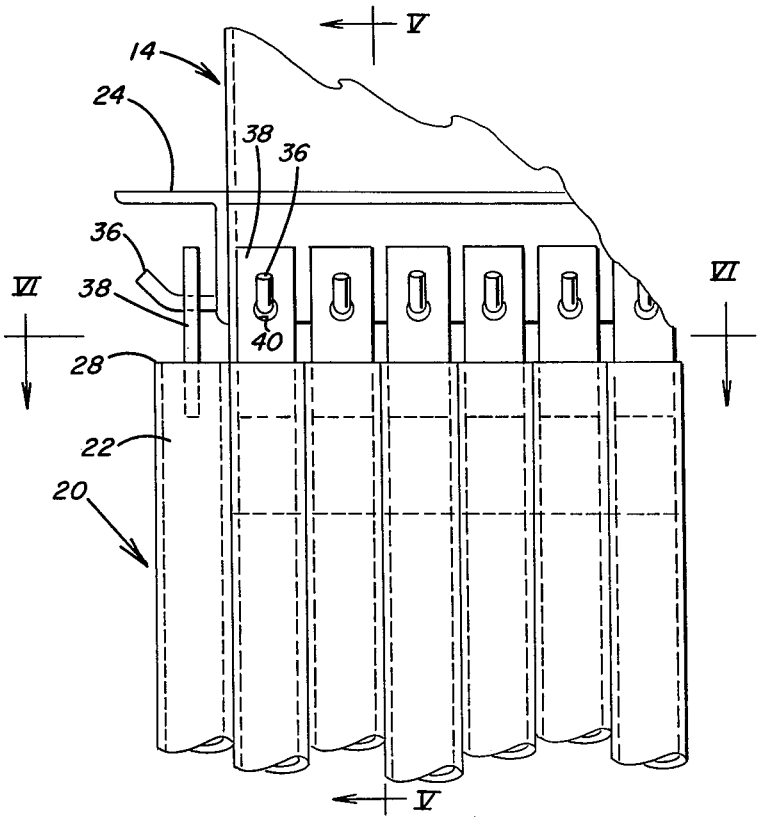
FIG. 4 schematically illustrates a second embodiment for individually suspending the pipes from an outwardly extending flange on the lower peripheral edge of the hood.
Figure 5:
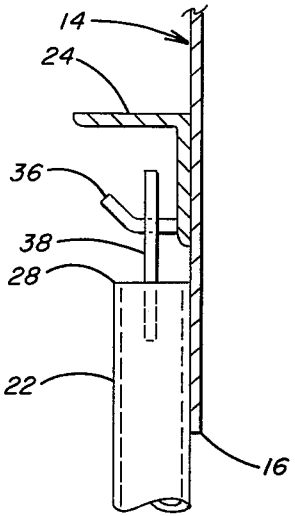
FIG. 5 is a fragmentary sectional view of the arrangement for suspending a pipe from the hood taken along Line 5—5 of FIG. 4.
Figure 6:
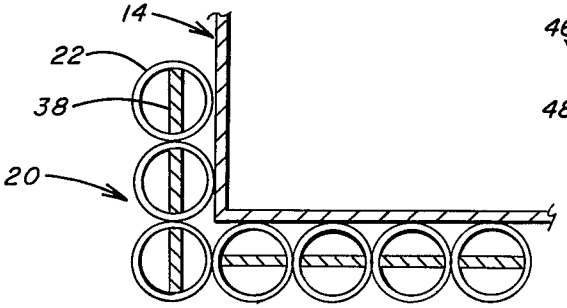
FIG. 6 is a fragmentary sectional view taken along Line 6—6 in FIG. 4.

Another embodiment for suspending the pipes from the peripheral flange 24 of the pollution control hood 14 is illustrated in FIGS. 4–6. In this embodiment the hood flange 24 includes an upwardly bent hanger 36 that extends outwardly from the lower edge of the flange 24 surrounding the opening 16 into the hood. The pipes in FIGS. 4–6 have a tubular configuration in which the pipes are hollow. A plate member 38 extends through the opening in the upper end porion 28 of each pipe 22 and is secured at one end portion in a suitable manner within the pipe as by welding. The upper end of the plate 38 that extends out of the pipe 22 is provided with an aperture 40 for receiving the hanger 36 extending outwardly from the hood flange 24.

The pipe 22, illustrated in FIG. 4, as well as the pipe 22 illustrated in FIG. 3, is releasably engageable with the flange 24. In this manner selected pipes 22 forming the curtain 20 may be removed or displaced so as to provide access into the space beneath the hood 14 and above the trough 12 without interferring with the overall enclosure formed by the curtain. It will be apparent with the arrangements illustrated in FIGS. 3 and 4 that the various means for connecting the pipes 22 to the hood flange 24 are adequately spaced around the entire periphery of the hood 14 so that the space beneath the hood 14 and above the trough 12 is completely enclosed. Furthermore, the various connecting devices are suitable spaced a preselected distance apart on the hood flange 24 so as to permit the pipes to be positioned in close relationship to one another as illustrated in FIG. 1 or in abutting relation as illustrated in FIGS. 4 and 6.

In FIG. 6 the pipes are supported in abutting relationship with one another and are suspended a distance outwardly from the flange 24 so as to enclose the lower periphery of the hood 14. This arrangement of suspending the individual pipes 22 from the hood 14 to form the curtain 20 provides improved heat transfer from the pollutants entering the hood 14. Particularly for pipes 22 of hollow construction, a substantial amount of the heat from the pollutants is transferred to the hollow pipes 22 thereby lowering the temperature of the pollutants entering the hood 14 and associated duct work. Thus, when the pollutants come in contact with the hood and duct work, they are at a lower temperature. This results in reduced warpage of these elements due to the reduced temperature of the pollutants.

Figure 7:
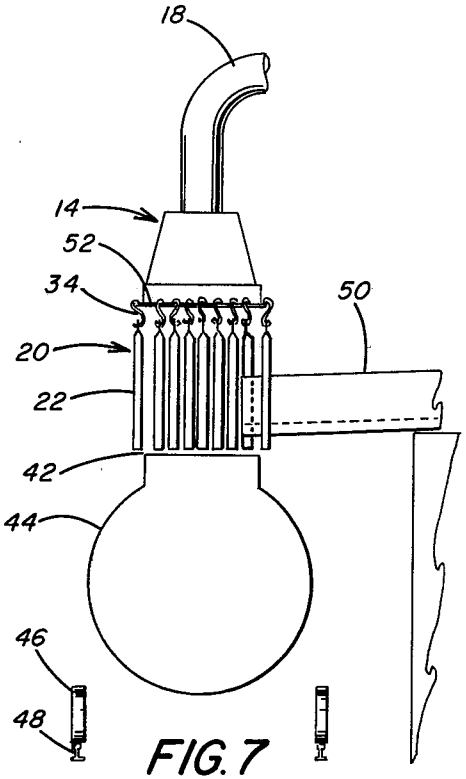
FIG. 7 schematically illustrates another arrangement for forming a pipe curtain between a pollution control hood and a ladle which receives molten metal from a spout where the pollutants emitted from the molten metal are confined within the area enclosed by the individually suspended pipes.

FIG. 7 illustrates another application of the pollution curtain 20 formed by the pipes 22 in accordance with the present invention in which the pipes 22 are independently suspended from a hood overlying an inlet 42 to a ladle 44. The ladle 44 may be suitably supported in a well-known manner on a frame 46 which is movable on rails 48 so as to permit the ladle 44 to be moved into and out of position relative to a spout 50. The spout 50 is arranged to extend from a furnace to permit the transfer of molten metal from the furnace into the ladle 44. By enclosing the space between the opening 42 of the ladle and the inlet of the hood 14 with the pipe curtain 20, the pollutants emitted from the molten metal are prevented from passing into the surrounding atmosphere. Thus, substantially all the pollutants are exhausted into the hood 14 and through the conduit 18 to the pollution control equipment.

With the arrangement illustrated in FIG. 7, the pipes 22 are suspended from a ring-like flange 52 that extends around the circular opening into the hood 14. By connecting devices 34, as illustrated in FIG. 3, the pipes 22 are individually suspended from the flange 52 in close relationship to one another. As a result of this arrangement, selected pipes of the curtain can be displaced from their vertical position to permit extension of the spout 50 through the curtain so that the outlet of the spout is positioned in overlying relation with the opening 42 to the ladle 44. The remaining pipes forming the curtain, however, are not displaced and the overall effect of the curtain is substantially maintained. Further as discussed above, selected access to the space above the ladle 44 can be achieved by removing individual pipes 22 from their connection with the flange 52 of the hood 14 without moving the entire curtain out of position.

Figure 8:
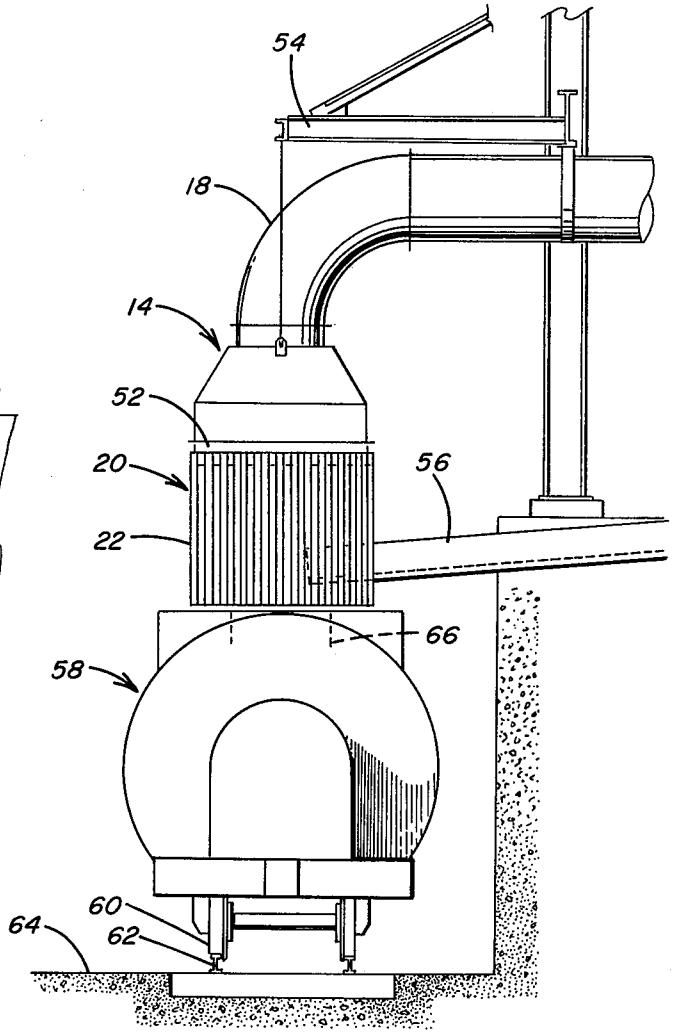
FIG. 8 illustrates a further application of the present invention in which a pipe curtain is suspended from a hood overlying the inlet to a hot metal car that receives molten metal from an inclined spout that extends into an enclosure formed by the pipe curtain.
Figure 9:
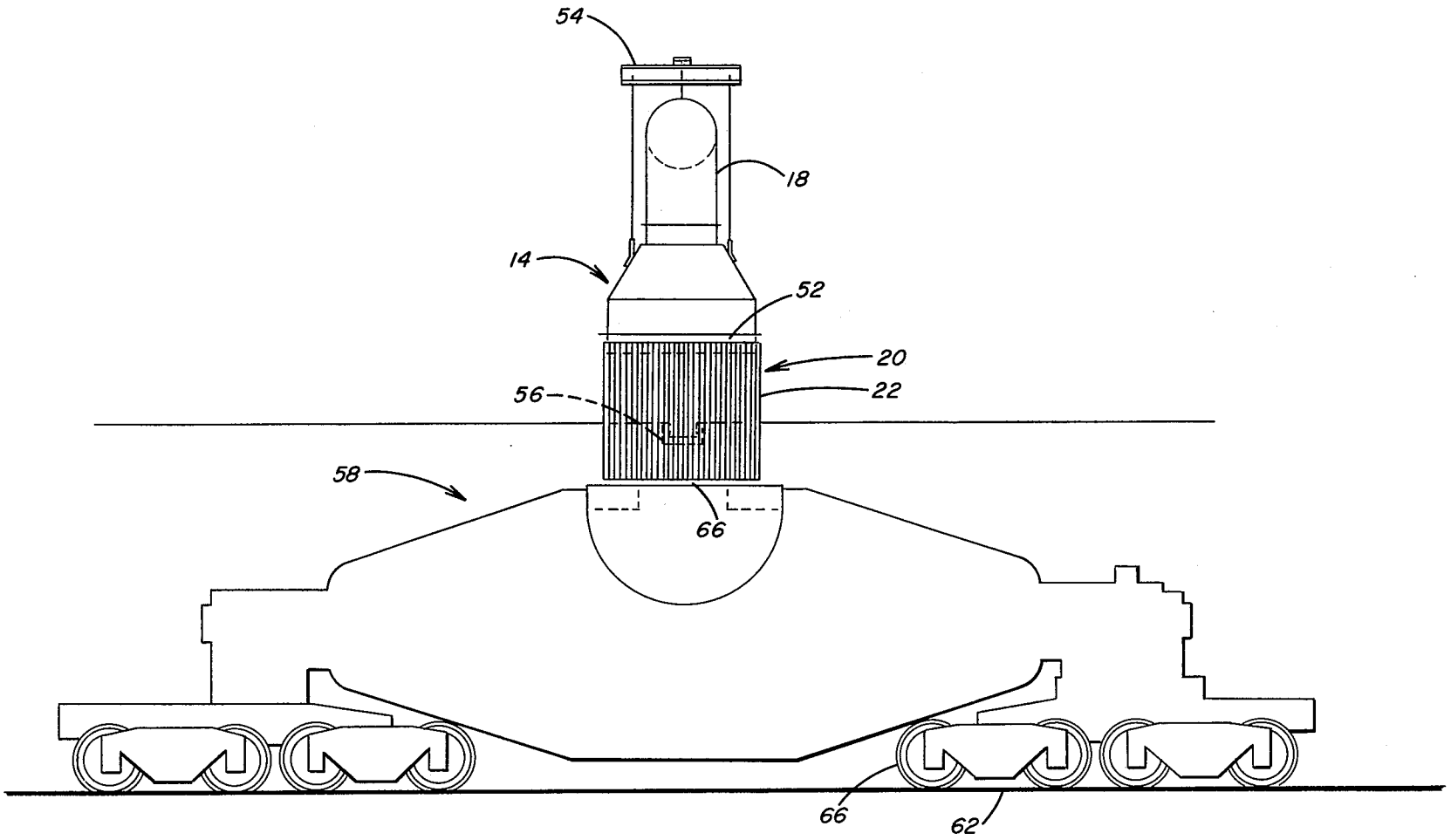
FIG. 9 is a view in side elevation of the pipe curtain associated with the hood and hot metal car shown in FIG. 8.

A further application of the pollution control curtain of the present invention is illustrated in FIGS. 8 and 9 in which the pollution control hood 14 is suspended by a frame 54 in overlying relation with a spout 56. The spout 56 is operable to convey molten metal from a furnace into a hot metal car generally designated by the numeral 58. The hot metal car 58 is provided with wheels 60 that engage rails 62 positioned on a bed 64. With this arrangement the hot metal car is movable into and out of receiving position with the spout 56 beneath the hood 14.

As with the arrangement illustrated in FIG. 7, the spout in FIG. 8 is extended through the pollution control curtain 20 by displacing only a few pipes 22 while the overall curtain remains in position to prevent escape of the pollutants to the surrounding atmosphere. When the hot metal is transferred from the spout 56 into the hot metal car 58, the smoke emitted from the hot metal is confined within the enclosure formed by the pipe curtain between the hood 14 and opening 66 into the hot metal car.

Also, as with the embodiments illustrated in FIGS. 1, 4 and 7, the pipes 22 in FIGS. 8 and 9 are suitably connected to the annular flange that extends around the lower peripheral edge of the hood 14. The pipes forming the curtain 20 in FIGS. 8 and 9 are positioned in abutting relation so as to substantially reduce the volume of ambient air that is pulled into the area beneath the hood 14 by the negative pressure created by the fan associated with duct 18. With this arrangement the capacity of the fan and the other air pollution control equipment can be substantially reduced to provide a more efficient and economical pollution control system.

Figure 10:
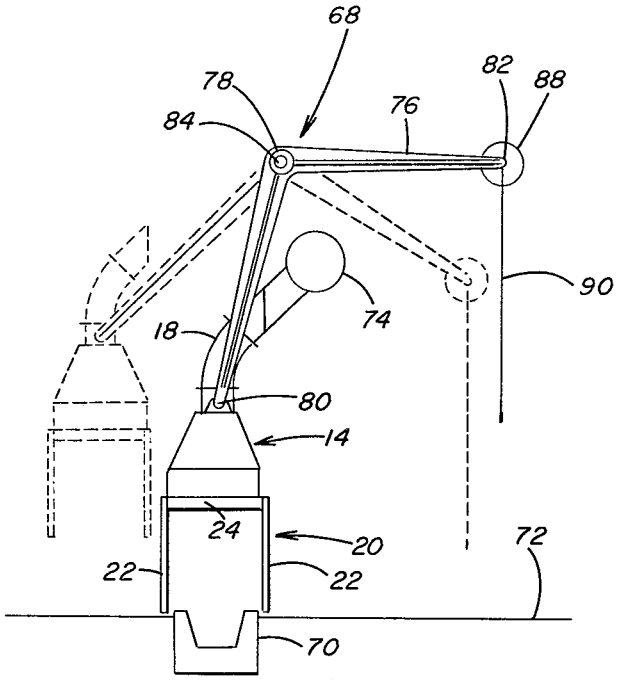
FIG. 10 schematically illustrates an additional embodiment of the present invention in which the hood together with the pipe curtain is movable into and out of overlying relation with a runner.
Figure 11:
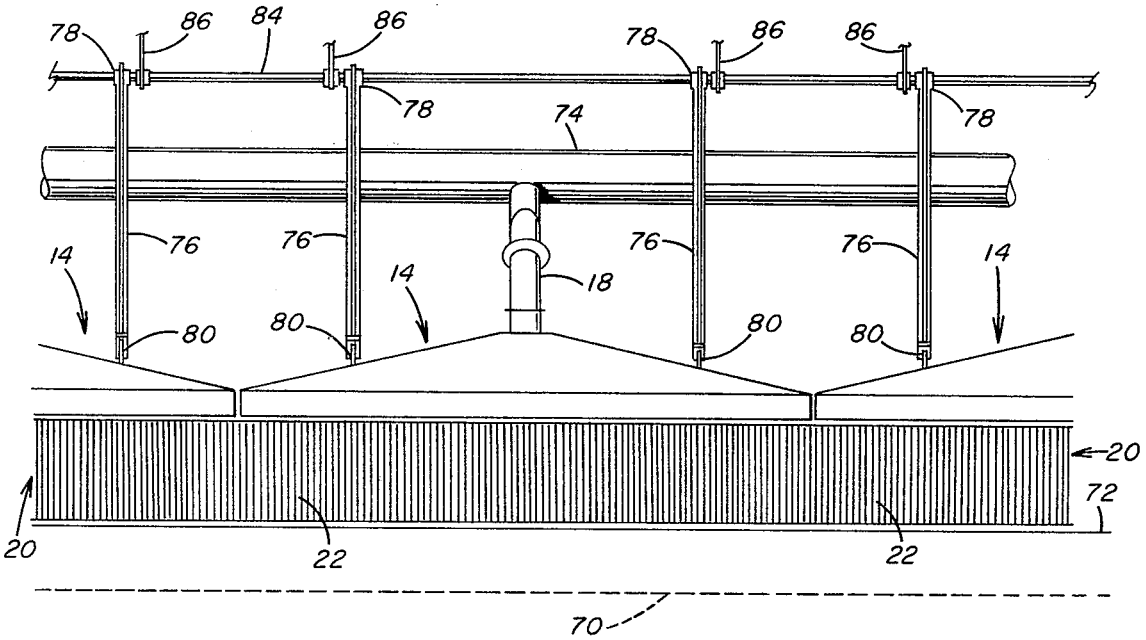
FIG. 11 is a fragmentary view in side elevation of the embodiment illustrated in FIG. 10.

Now referring to FIGS. 10 and 11 there is illustrated an additional embodiment of the pollution control curtain of the present invention. As illustrated in FIGS. 10 and 11, the pollution control hood 14 is suspended from a movable frame generally designated by the numeral 68 in overlying relation with a runner 70. The runner 70 is suitably supported in a floor 72 of the industrial installation and is adapted to extend for a suitable distance thereon, as for example, from the discharge of a metallurgical furnace at one end to a metal transporting device or vessel at the opposite end.

The hood 14 is positioned a suitable distance above the runner 70 to extend the length of the runner. The pipe curtain 20 is supported by the hood 14 to extend downwardly from the hood 14 to a position spaced above the floor 72 and adjacent to the upper peripheral edge of the runner 70. The pollutants emitted from the molten metal conveyed in the runner 70 are confined within the enclosure formed by the pipe curtain 20 between the hood 14 and the open upper end of the runner 70.

The pipes 22 forming the pollution control curtain 20 are suitably connected to the angular flange 24 that extends around the lower peripheral edge of the hood 14, as illustrated in FIG. 10. The connection of the individual pipes 22 to the annular flange 24 is preferably accomplished by the connection illustrated in either FIG. 3 or in FIG. 4. In both cases the pipes 22 are individually, movably connected to the hood 14 so as to permit displacement of one pipe 22 from a vertically hanging position with respect to the other pipes 22 of the curtain 20.

As discussed above with regard to the other embodiments of the present invention, the curtain 20 illustrated in FIGS. 10 and 11 is formed by pipes 22 which are positioned in abutting relation so as to substantially reduce the volume of ambient air that is pulled into the area beneath the hood 14 by the negative pressure created by the fan associated with duct 18 that extends upwardly from the discharge outlet of the hood 14. The duct 18 is connected at one end to the discharge outlet of hood 14 and at the opposite end to a header 74. The header 74 leads to a pollution collection facility, such as a bag house having apparatus such as fans and the like for creating a negative pressure in the header 74, the duct 18 and the hood 14 for drawing the pollutants emitted from the material in the runner 70 to the bag house for appropriate disposal.

Further in accordance with the present invention as illustrated in FIGS. 10 and 11, the pollution control hood 14, as well as, the independently supported pipes 22 of the pipe curtain 20 are movable into and out of an operative position above the runner 70. As illustrated by the solid lines in FIG. 10, the hood 14 and the pipe curtain 20 are positioned in an operative position above the runner 70 to collect the pollutants emitted from the molten metal conveyed through the runner 70. When the hood 14 and pipe curtain 20 are not in operation, both the hood 14 and pipe curtain 20 may be moved upwardly and laterally relative to the runner 70 to the position indicated by the dotted lines in FIG. 10 by the movable frame 68. This permits free access to the runner 70 for conducting maintenance of the runner.

The movable frame 68 includes a plurality of pivot arm members 76 which are each pivotally connected at a point 78 intermediate arm end portions 80 and 82 to a rigid arm member 84 that is suitably supported in the industrial facility from an overhead structure (not shown) by brace members 86. The arm members 76 are spaced apart a suitable distance on the rigid arm member 84 and are pivotal about the arm member 84 by the connection of each arm member intermediate point 78 with the rigid arm member 84. The arm member end portions 80 are suitably connected to the hood 14, and a counterweight 88 is connected to each arm member opposite end portion 82.

By pivoting the arm members 76 on the rigid arm member 84, the hood 14 and the pipe curtain 20 are operable to be moved from their normally overlying position with the runner 70 to a position displaced laterally and upwardly from the runner 70. With the hood 14 and the pipe curtain 20 in the raised position displaced from the runner 70, as illustrated by the dotted lines in FIG. 10, unobstructed access to the runner 70 is permitted. Pivoting of the arm members 76 can be accomplished by a mechanically powered system, which will be apparent to those skilled in the art and therefore will not be discussed herein or by manually pivoting the arm members 76 to raise the hood 14 and pipe curtain 20 by pulling downwardly upon a guide line 90 secured to and extending from each arm member portion 82.

With the above described arrangement, all of the individual pipes 22 forming the pipe curtain 20 are moved in unison from an operative position above the runner 70 to a position displaced from overlying relation with the runner 70. Also, each pipe 22 forming the pipe curtain 20 is individually movable relative to the remaining pipes 22 forming the curtain 20 by the connection of the upper end portion of each pipe 22 to the flange 24 that extends around the lower end of the hood 14. The connection of each pipe 22 to the hood flange 24 may be accomplished by the arrangement illustrated in FIG. 3 or FIG. 4 as discussed hereinabove. Both of these arrangements permit a pipe 22 to be displaced from a downwardly hanging position above the runner 70 to provide access to the runner 70 while the remaining pipes 22 remain suspended in a vertically hanging position.

It will be also apparent from FIG. 11 that in the situation where the runner 70 exceeds the length of a single hood 14, a plurality of hoods 14 may be positioned in end to end relation above the runner 70 to extend the length of the runner 70. Each hood 14 is provided with the downwardly hanging pipe curtain 20 where the pipe curtain 20 of one hood 14 joins with the pipe curtain 20 of an adjacent hood 14 to form a continuous pipe curtain the length of the runner 70. This arrangement directs the pollutants emitted from the runner 70 upwardly into the complex of hoods 14 and minimizes the volume of ambient air drawn into the hoods 14.

The pipe curtain 20 formed by the individual pipes 22 also includes the pipes positioned in abutting relation as illustrated in FIG. 4 or positioned closely adjacent to one another as illustrated in FIG. 1. In any event the individually suspended pipes 22 serve to direct the pollutants upwardly from the runner 70 into the inlet of the hood 14 and therefrom through the hood 14, duct 18, and header 74 to a suitable location in the industrial facility for collection and disposal of the pollutants. This is accomplished with a minimum volume of air surrounding the exterior of the hood 14 from being drawn into the hood 14 with the resultant advantage of utilizing pollution control equipment, such as motors, fans, scrubbers and the like having reduced power requirements.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. Apparatus for controlling the flow of air and pollutants drawn into a pollution control hood comprising, a plurality of pipe-like members arranged individually to extend downwardly from the pollution control hood, said pipe-like members being positioned independently in side-by-side relation to form a curtain around the pollution control hood and thereby adapted to enclose the opening into the hood, said pipe-like members each having a first end portion individually connected to the pollution control hood and a second end portion movably positioned in close proximity to the periphery of a vessel from which the pollutants are emitted to permit movement of said pipe-like members individually relative to each other to allow access into the area beneath the hood, and said curtain formed by said pipe-like members being operable to reduce the volume of air drawn into the hood and combined with the emitted pollutants.

2. Apparatus for controlling the flow of air and pollutants drawn into a pollution control hood as set forth in claim 1 which includes, means for freely suspending said pipe-like members individually from the hood to enclose the area below the pollution control hood and thereby restrict the volume of air drawn into the hood.

3. Apparatus for controlling the flow of air and pollutants drawn into a pollution control hood as set forth in claim 1 which includes, said first end portions of said pipe-like members being movably connected to the pollution control hood to permit access into the area beneath the pollution control hood by displacement of selected ones of said pipe-like members from a downwardly hanging position.

4. Apparatus for controlling the flow of air and pollutants drawn into a pollution control hood as set forth in claim 1 which includes, connecting means for releasably connected said first end portions of said pipe-like members to the lower peripheral edge of the pollution control hood so that each of said pipe-like member is independently suspended from the pollution control hood.

5. Apparatus for controlling the flow of air and pollutants drawn into a pollution control hood as set forth in claim 1 which includes, a connecting device secured to said first end portion of each of said pipe-like members, and said connecting device being releasably engageable with the pollution control hood to support said pipe-like member to hang vertically from the pollution control hood.

6. Apparatus for controlling the flow of air and pollutants drawn into a pollution control hood as set forth in claim 1 which includes, a connecting device being adaptable to engage an outwardly extending flange positioned around the lower peripheral edge of the pollution control hood, said connecting device connected to said first end portion of each of said pipe-like members, and said connecting device being pivotal about the outwardly extending flange to permit selective displacement of individual ones of said pipe-like members while maintaining connection of said pipe-like members to the flange to provide access into the area beneath the hood.

7. Apparatus for controlling the flow of air and pollutants drawn into a pollution control hood as set forth in claim 1 which includes, said pipe-like members having a hollow tubular construction to facilitate the transfer of heat from the pollutants to the curtain to thereby lower the temperature of the pollutants entering the pollution control hood and reduce warpage of the pollution control hood.

8. Apparatus for controlling the flow of air and pollutants drawn into a pollution control hood as set forth in claim 1 which includes, said plurality of pipe-like members being connected to the pollution control hood to extend downwardly in close relation to each other to enclose the space between the hood and the vessel from which the pollutants are emitted.

9. Apparatus for controlling the flow of air and pollutants drawn into a pollution control hood as set forth in claim 1 which includes, said curtain being formed by said plurality of pipe-like members having sufficient weight to remain in place to resist displacement by the flow of air into the hood and thereby maintain an enclosure through which air and the pollutants are drawn into the hood.

10. Apparatus for controlling the flow of air and pollutants drawn into a pollution control hood as set forth in claim 1 which includes, said plurality of pipe-like members being positioned in abutting relation to form said curtain, and said curtain enclosing the space between the pollution control hood and the vessel from which the pollutants are emitted to reduce the volume of air drawn into the hood.

11. Apparatus for controlling the flow of air and pollutants drawn into a pollution control hood as set forth in claim 1 which includes, said plurality of pipe-like members being adapted for connection at said first end portions thereof to the bottom edge of the pollution control hood to extend vertically downwardly from the hood into surrounding relation with the vessel from which the pollutants are emitted and to be displaced individually from a vertical position.

12. Apparatus for controlling the flow of air and pollutants drawn into a pollution control hood as set forth in claim 1 which includes, means connected to the pollution control hood for moving all of said pipe-like members forming said curtain together with the pollution control hood between a first position for directing the flow of pollutants into the hood and a second position displaced from said first position.

* * * * *